US010299976B2

(12) United States Patent
Lo

(10) Patent No.: US 10,299,976 B2
(45) Date of Patent: May 28, 2019

(54) BED FOR PATIENTS

(71) Applicant: Chiu Hsiang Lo, Taichung (TW)

(72) Inventor: Chiu Hsiang Lo, Taichung (TW)

(73) Assignee: DK CITY CORPORATION, Taichung (TW)

( * ) Notice: Subject to any disclaimer, the term of this patent is extended or adjusted under 35 U.S.C. 154(b) by 426 days.

(21) Appl. No.: 15/288,790

(22) Filed: Oct. 7, 2016

(65) Prior Publication Data

US 2018/0098898 A1 Apr. 12, 2018

(51) Int. Cl.

| | |
|---|---|
| ***A61G 7/015*** | (2006.01) |
| ***A47C 21/00*** | (2006.01) |
| ***A47C 27/10*** | (2006.01) |
| ***A61G 7/00*** | (2006.01) |
| ***A61G 7/018*** | (2006.01) |
| ***A47C 20/04*** | (2006.01) |
| ***A61G 7/07*** | (2006.01) |

(52) U.S. Cl.

CPC ..... *A61G 7/018* (2013.01); *A61G 7/015* (2013.01); *A61G 7/07* (2013.01); *A47C 20/04* (2013.01); *A47C 21/00* (2013.01); *A47C 27/10* (2013.01)

(58) Field of Classification Search

CPC ..... A61G 7/00; A61G 7/018; A61G 7/015; A61G 7/07; A47C 21/00; A47C 27/00; A47C 20/04

See application file for complete search history.

(56) References Cited

U.S. PATENT DOCUMENTS

| | | | | |
|---|---|---|---|---|
| 5,537,701 | A * | 7/1996 | Elliott | A47C 19/005 5/616 |
| 5,640,730 | A * | 6/1997 | Godette | A47C 20/041 5/617 |
| 7,648,473 | B1 * | 1/2010 | Peruvingal | A61F 5/3776 5/613 |
| 2002/0144350 | A1 * | 10/2002 | Shih | A47C 20/041 5/620 |
| 2004/0194213 | A1 * | 10/2004 | Weinman | A47C 20/041 5/618 |
| 2005/0172405 | A1 * | 8/2005 | Menkedick | A61B 5/1115 5/618 |
| 2011/0094032 | A1 * | 4/2011 | Shih | A47C 20/041 5/614 |

(Continued)

*Primary Examiner* — Eric J Kurilla
*Assistant Examiner* — Rahib T Zaman
(74) *Attorney, Agent, or Firm* — Bruce Stone LLP; Joseph Bruce

(57) ABSTRACT

An electric bed includes a basic unit and a lift unit. The basic unit includes a base, a sliding frame supported on the base, a backrest frame pivotally connected to the sliding frame, a headrest frame pivotally connected to the backrest frame, and a restraint including an end pivotally connected to the base and another end pivotally connected to the backrest frame. The backrest frame includes a lug that includes a slot. The lift unit includes a power element pivotally connected to the sliding frame, a rod operatively connected to the power element, a backrest driver pivotally connected to the rod, a headrest driver pivotally connected to the backrest driver, a backrest lever for pivotally connecting the backrest driver to the backrest frame, a roller supported on the backrest lever, and a threaded bolt inserted in the backrest driver and the slot of the lug of the backrest frame.

9 Claims, 13 Drawing Sheets

(56) References Cited

U.S. PATENT DOCUMENTS

| | | | | |
|---|---|---|---|---|
| 2014/0041121 | A1* | 2/2014 | Shan | A47C 21/006 5/618 |
| 2016/0206489 | A1* | 7/2016 | Rawls-Meehan | A47C 20/04 |

* cited by examiner

BED FOR PATIENTS

BACKGROUND OF INVENTION

1. Field of Invention

The present invention relates to a bed for patients and, more particularly, to a bed with an automatic backrest assembly.

2. Related Prior Art

As disclosed in U.S. Pat. No. 8,209,800, a conventional electric bed includes a primary frame 10 that includes three structural components 11, 12 and 13. A driver 20 includes a positioning portion pivotally connected to the structural component 11 and a through hole for receiving a control pin 33. An end of a link rod 30 is inserted in each angle bracket 16. The control pin 33 is inserted in the link rod 30 and a slot 161 made in the angle bracket 16. Another end of the link rod 30 is pivotally connected to each angle bracket 17 that is secured to the structural component 13. The use of this conventional electric bed 10 is not without any problems. Firstly, the link rod 30 is unstable because the slot 161 is located close to the driver 20 and the angle brackets 16 and 17 are formed on different structural components 12 and 13. Secondly, the link rod 30 is not useful for lifting the structural component 11 because it extends substantially parallel to the structural component 11 and relies on the driver 20.

The present invention is therefore intended to obviate or at least alleviate the problems encountered in prior art.

SUMMARY OF INVENTION

It is the primary objective of the present invention to provide a convenient electric bed.

To achieve the foregoing objective, the electric bed includes a basic unit and a lift unit. The basic unit includes a base, a sliding frame supported on the base, a backrest frame pivotally connected to the sliding frame, a headrest frame pivotally connected to the backrest frame, and at least one restraint including an end pivotally connected to the base and another end pivotally connected to the backrest frame. The backrest frame includes at least one lug that includes a slot that includes a closed end. The lift unit includes a power element connected to the sliding frame, a rod operatively connected to the power element, a backrest driver pivotally connected to the rod, a headrest driver pivotally connected to the backrest driver, a backrest lever for pivotally connecting the backrest driver to the backrest frame, a roller supported on the backrest lever, and a threaded bolt inserted in the backrest driver and the slot of the lug of the backrest frame. The lift unit is operable to cause the backrest driver to move the threaded bolt in the slot and cause the headrest driver to lift the headrest frame. The roller is away from the backrest frame before the threaded bolt reaches the closed end of the slot. The roller is in contact with the backrest frame when the threaded bolt reaches the closed end of the slot.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
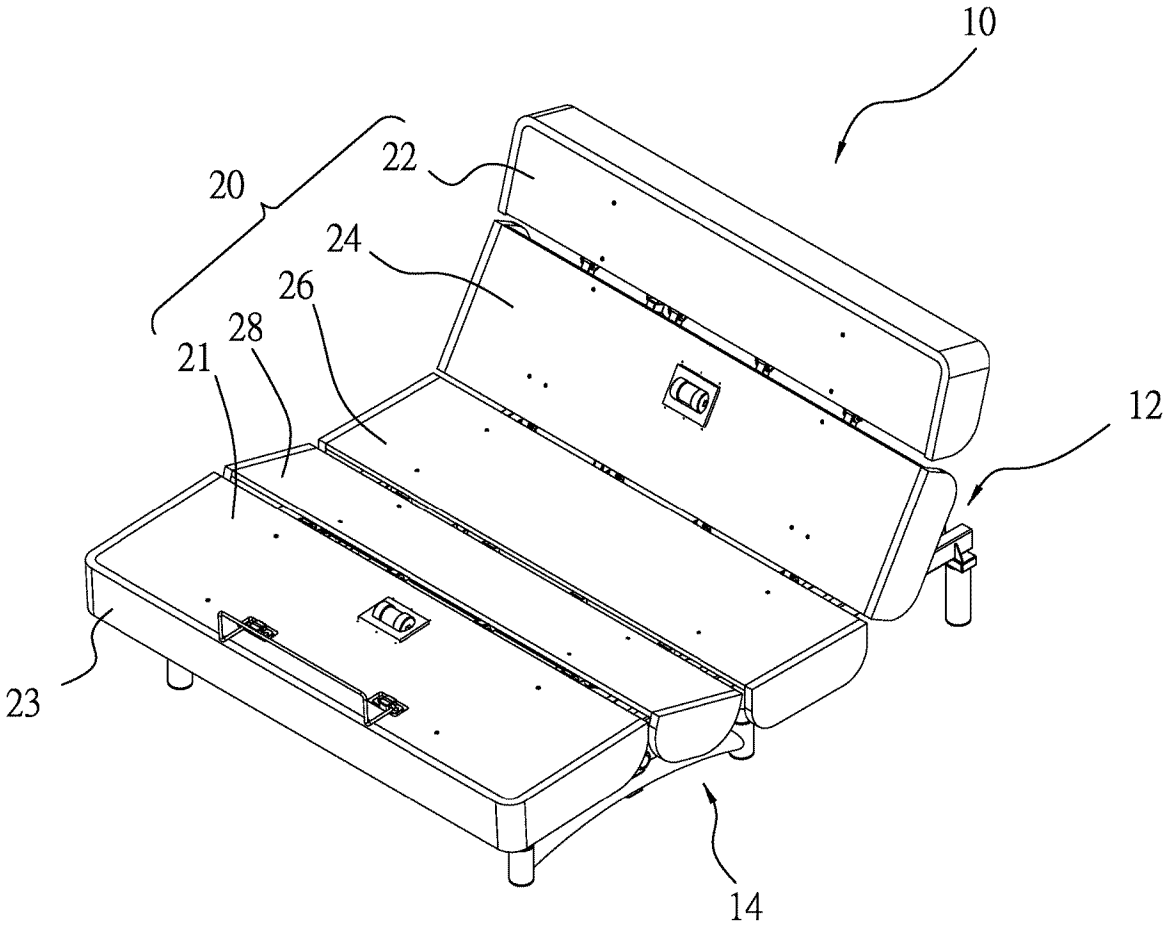
FIG. 1 is a perspective view of an electric bed according to the preferred embodiment of the present invention.
Figure 2:
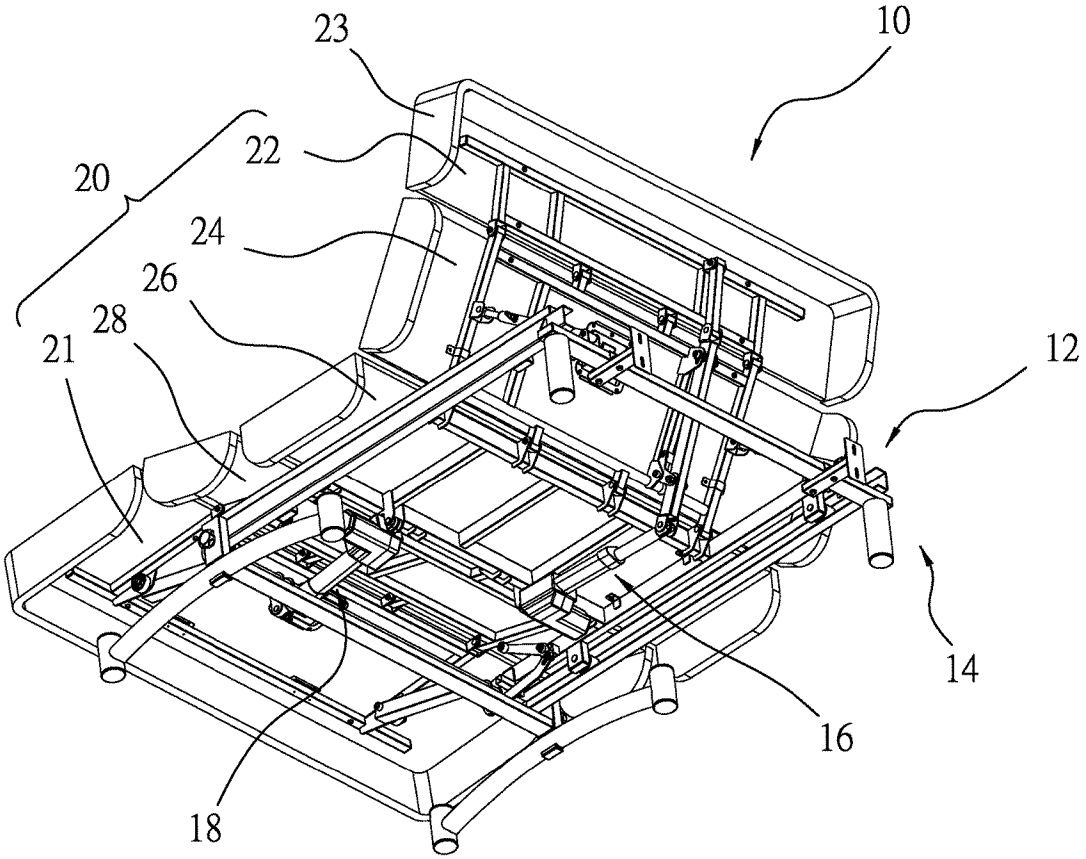
FIG. 2 is another perspective view of the electric bed shown in FIG. 1.
Figure 3:
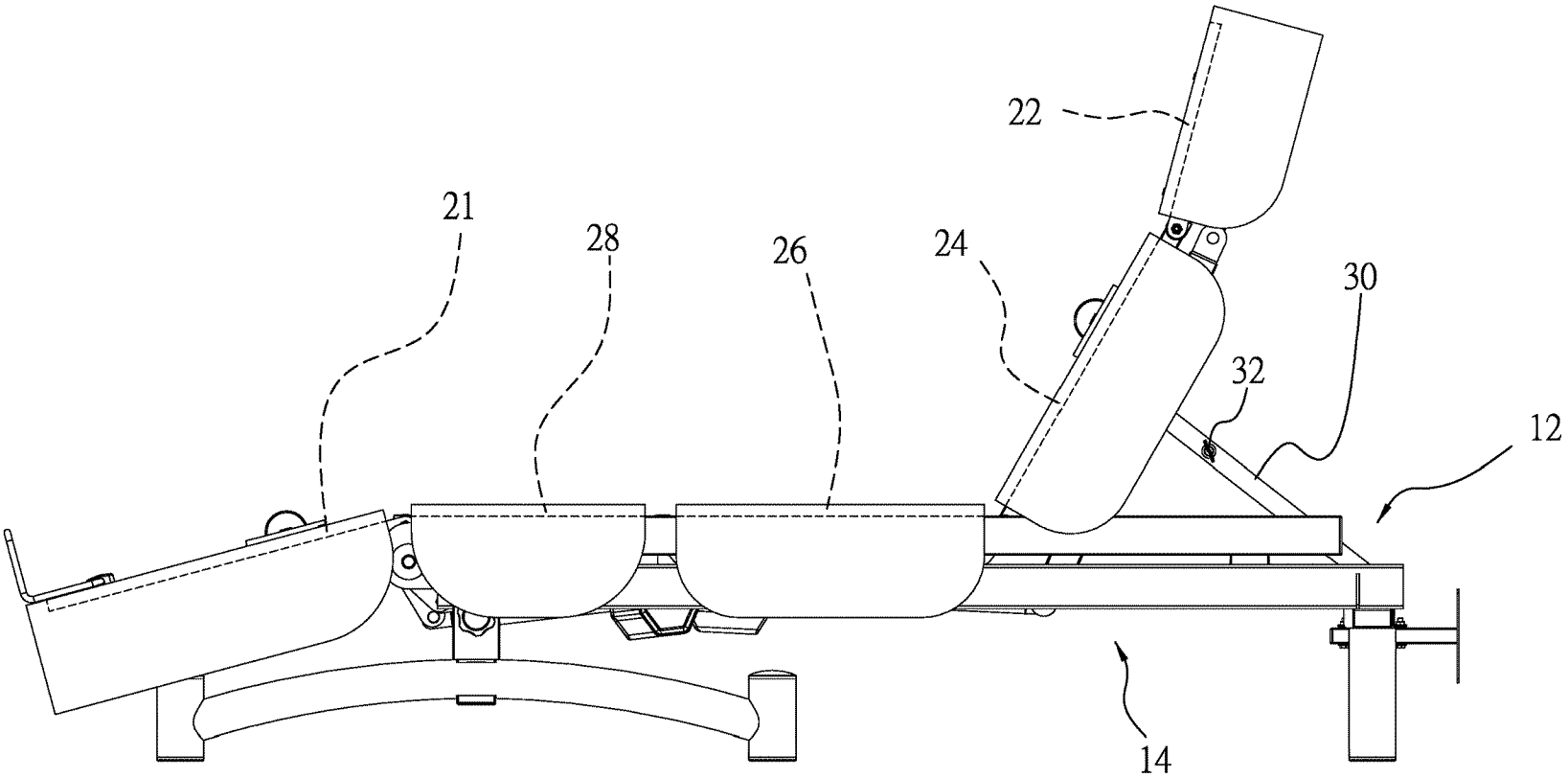
FIG. 3 is a side view of the electric bed shown in FIG. 1.

Referring to FIGS. 1 through 3, an electric bed 10 includes a board assembly 20 supported on a support structure 12 according to the preferred embodiment of the present invention. The board assembly 20 includes a headrest 22, a backrest 24, a middle board 26, an upper leg-rest 28, a lower leg-rest 21 and protective elements 23. The headrest 22, the backrest 24, the middle board 26, the upper leg-rest 28 and the lower leg-rest 21 are flat elements. The protective elements 23 extend around the board assembly 20. The protective elements 23 are softer than lower leg-rest 21, the headrest 22, the backrest 24, the middle board 26 and the upper leg-rest 28. The protective elements 23 are made of a foam material for example.

The board assembly 20 can be located in various positions. For example, referring to FIG. 1, the headrest 22, the backrest 24, the upper leg-rest 28 and the lower leg-rest 21 are lifted. Referring to FIG. 3, only the headrest 22 and the backrest 24 are lifted while the lower leg-rest 21 and the upper leg-rest 28 are laid down as well as the middle board 26.

The support structure 12 includes a basic unit 14 and two lift units 16 and 18. The lift unit 16 is used to lift the headrest 22 and the backrest 24. The lift unit 18 is used to lift the lower leg-rest 21 and the upper leg-rest 28.

Figure 4:
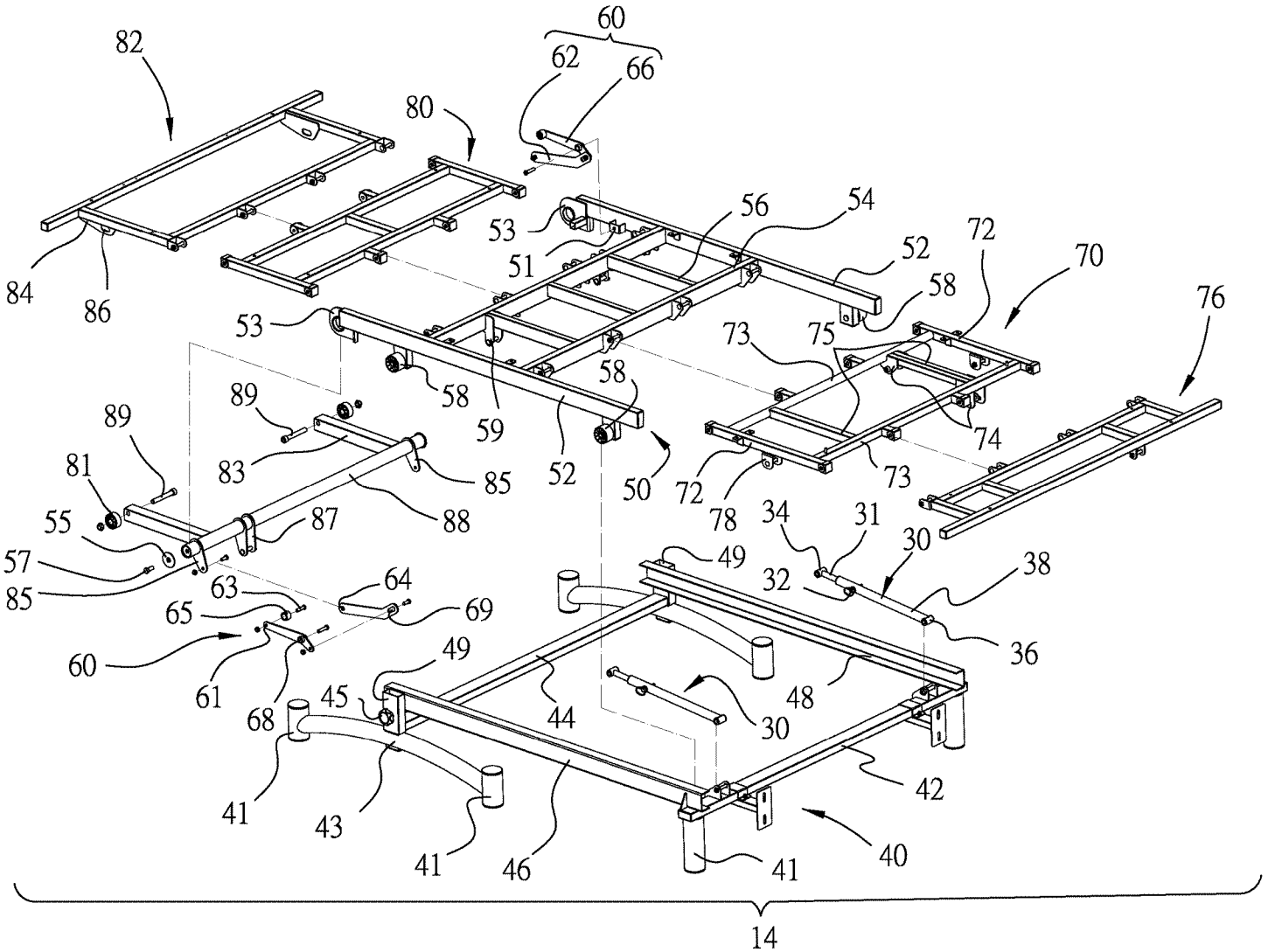
FIG. 4 is an exploded view of the electric bed shown in FIG. 1.
Figure 5:
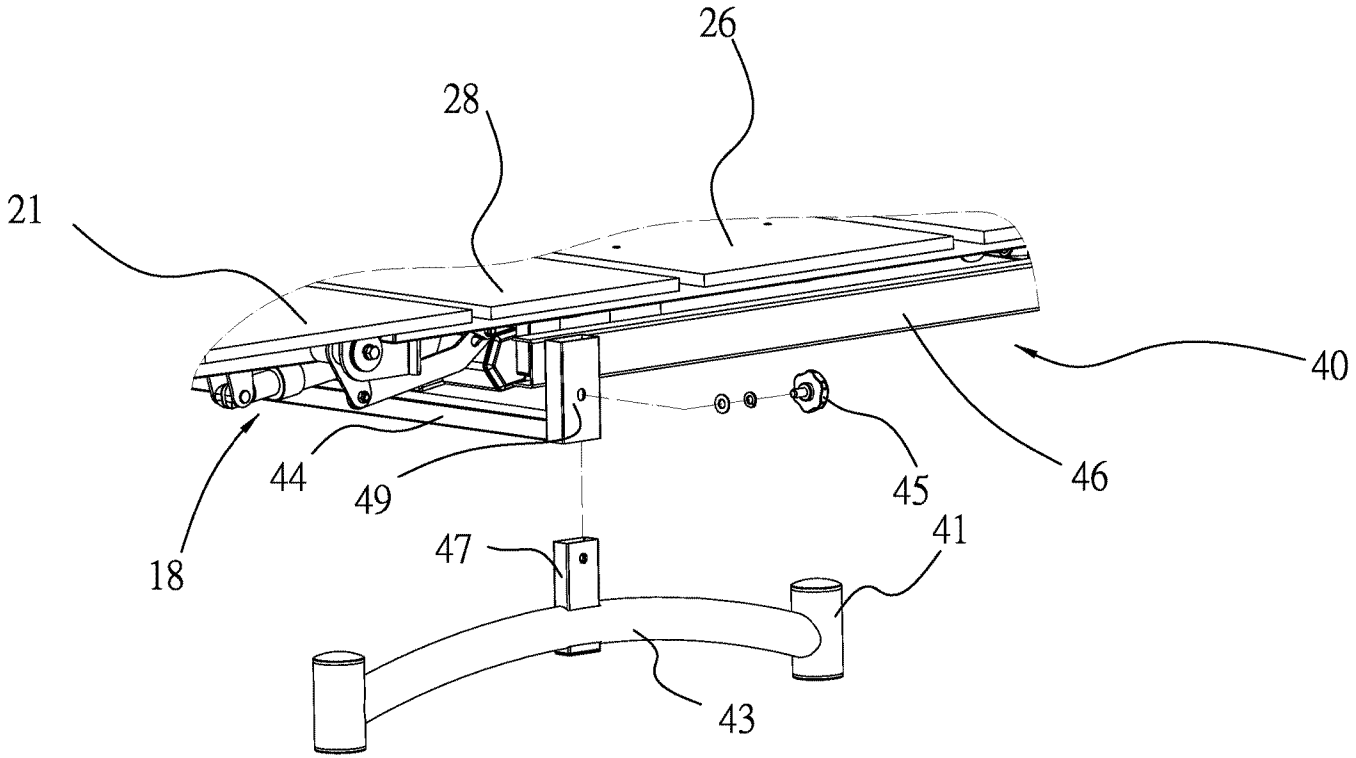
FIG. 5 is an enlarged partial view of the electric bed shown in FIG. 1.

Referring to FIGS. 2, 4 and 5, the basic unit 14 includes two restraints 30, a base 40, two linkages 60, a backrest frame 70, a headrest frame 76, an upper leg-rest frame 80, a lower leg-rest frame 82 and a crankshaft 88. The sliding frame 50 is secured to a lower portion of the middle board 26. The backrest frame 70 is secured to a lower portion of the backrest 24. The headrest frame 76 is secured to a lower portion of the headrest 22. The upper leg-rest frame 80 is secured to a lower portion of the upper leg-rest 28. The lower leg-rest frame 82 is secured to a lower portion of the lower leg-rest 21.

The restraints 30 and the sliding frame 50 are supported on the base 40. The linkage 60, the backrest frame 70, the headrest frame 76, the upper leg-rest frame 80, the lower leg-rest frame 82 and the crankshaft 88 are connected to the sliding frame 50 by various joints.

The base 40 includes a rectangular frame that includes a front bar 42, a rear bar 44 and two lateral bars 46 that are connected to one another by welding for example. A track 48 is made on or in each lateral bar 46. Preferably, the track 48 is a groove made in each lateral bar 46. A tube 49 is secured to each lateral bar 46 by welding for example. Each track 48 and the corresponding tube 49 are on two opposite sides of the corresponding lateral bar 46. The rear bar 44 is located between and secured to the tubes 49 by welding for example.

The base 40 further includes two supports 43 each extending along an arch. Each support 43 includes a post 47 secured to a middle portion thereof by welding for example and two struts 41 each secured to an end thereof by welding for example. Each post 47 is inserted in a corresponding tube 49 before a fastener 45 is used to keep the former in the latter. Two more struts 41 are secured to the front bar 42 by welding for example. In use, the struts 41 are laid on a floor.

The sliding frame 50 includes two lateral bars 52, two crossbars 54 located between and secured to the lateral bars 52 by welding for example, and longitudinal bars 56 located between and secured to the crossbars 54 by welding for example. A group of casters 58 is connected to a lower portion of each lateral bar 52. Each group of casters 58 is movable on or in a corresponding track 48 to render the sliding frame 50 smoothly movable to and fro on the base 40. An extensive element 53 is secured to an end of each lateral bar 52 by welding for example. A positioning element 51 is secured to an internal side of each lateral bar 52 by welding for example. Two pairs of holding elements 59 are secured to a lower portion of one of the longitudinal bars 56.

In another embodiment, the sliding frame 50 does not include any caster, and the sliding frame 50 is combined with the base 40. That is, the sliding frame 50 and the base 40 are made one.

Figure 6:
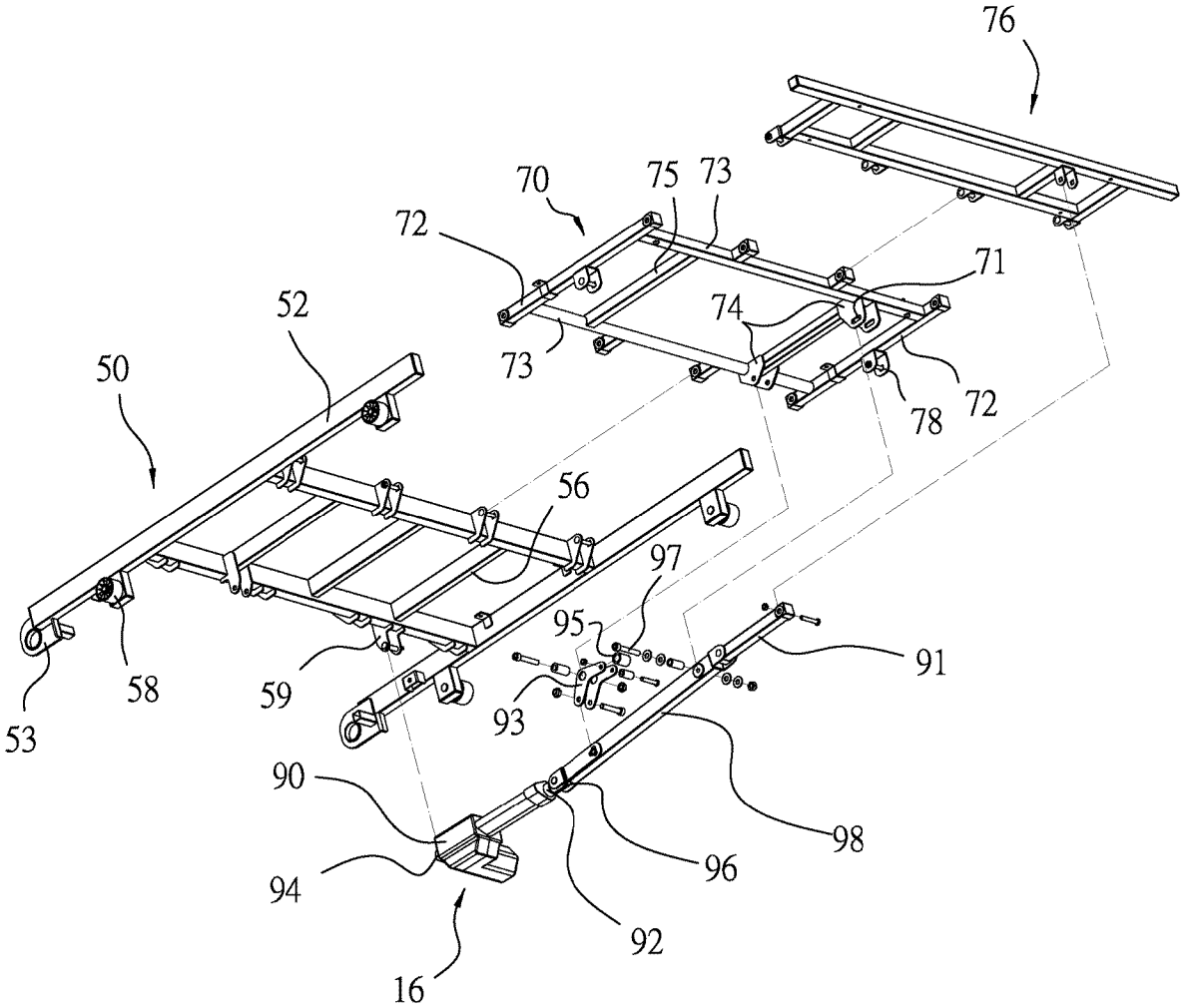
FIG. 6 is an enlarged perspective view of a lift unit of the electric bed shown in FIG. 2.

The backrest frame 70 includes two lateral bars 72, two crossbars 73 located between and secured to the lateral bars 72 by welding for example, and two longitudinal bars 75 located between and secured to the crossbars 73 by welding for example. One of the crossbars 73 is pivotally connected to one of the crossbars 54 to allow the backrest frame 70 to pivot relative to the sliding frame 50. Two pairs of lugs 74 are secured to one of the longitudinal bars 75 by welding for example. In one pair, each lug 74 includes a slot 71 (FIG. 6). In the other pair, each lug 74 includes an aperture (not numbered). A supportive element 78 is secured to each lateral bar 72 by welding for example and pivotally connected to the connective end 34 of a corresponding restraint 30. Thus, the restraints 30, the base 40 and the backrest frame 70 are connected to one another by the sliding frame 50.

Each restraint 30 includes a connective end 34 and a movable end 36. Each restraint 30 is preferably an extensible element in the foul) of a pneumatic or hydraulic cylinder device that includes a rod 31 operatively connected to a cylinder 38. Normally, the length of each restraint 30 is retained by inserting a pin 32 in the cylinder 38 to keep the rod 31 in position relative to the cylinder 38. If necessary, the length of each restraint 30 can be changed by removing the pin 32 from the cylinder 38 to allow the rod 31 to withdraw into or extend from the cylinder 38. The movable end 36 of each restraint 30, which is an end of the cylinder 38 opposite to the rod 31, is pivotally connected to the front bar 42. The connective end 34 of each restraint 30, which is an end of the rod 31 opposite to the cylinder 38, is pivotally connected to a lower portion of the backrest frame 70.

The restraint 30 can be an element such as a rod or a tube that is made of fixed length in another embodiment.

The headrest frame 76 includes two lateral bars (not numbered), two crossbars (not numbered) secured to the lateral bars thereof by welding for example, and longitudinal bars (not numbered) located between and secured to the crossbars thereof by welding for example. The headrest frame 76 is pivotally connected to the backrest frame 70, opposite to the sliding frame 50.

The upper leg-rest frame 80 includes two lateral bars (not numbered), two crossbars (not numbered) located between and secured to the lateral bars thereof by welding for example, and a longitudinal bar (not numbered) located between and secured to the crossbars thereof by welding for example. The upper leg-rest frame 80 is pivotally connected to the sliding frame 50, opposite to the backrest frame 70. The upper leg-rest frame 80 can be pivoted on the sliding frame 50. The upper leg-rest frame 80 is located between the lateral bars 52 of the sliding frame 50.

The lower leg-rest frame 82 includes two lateral bars (not numbered), two crossbars (not numbered) secured to the lateral bars thereof by welding for example, and longitudinal bars (not numbered) located between and secured to the crossbars thereof by welding for example. The lower leg-rest frame 82 is pivotally connected to the upper leg-rest frame 80, which is pivotally connected to the sliding frame 50, so that the lower leg-rest frame 82 can be pivoted relative to the upper leg-rest frame 80 and the sliding frame 50. The lower leg-rest frame 82 includes two lugs 84 each including a slot 86.

The crankshaft 88 is forming with two cranks 83, two lateral cranks 85 and a pair of cranks 87. The pair of cranks 87 is located between the lateral cranks 85. A caster 81 is supported on an axle 89 that is inserted in the slot 86 of each lug 84 and a corresponding crank 83. Thus, the cranks 83 are pivotally connected to the lower leg-rest frame 82, and each caster 81 is connected to a corresponding crank 83. Each caster 81 can be a roller bearing.

The crankshaft 88 is placed between the extensive elements 53. Each end of the crankshaft 88 is inserted in a bore (not numbered) made in a corresponding extensive element 53. A threaded bolt 57 is inserted in each end of the crankshaft 88 via the corresponding extensive element 53 and a washer 55 that is useful for absorbing vibration and hence avoiding removal of the threaded bolts 57 from the crankshaft 88. Each lateral crank 85 is connected to a corresponding lateral bar 52 by a linkage 60.

Each linkage 60 includes two levers 62 and 66. The lever 62 includes an aperture 64 and a slot 69. The lever 66 is made with two apertures 61 each located near an end thereof and an aperture 68 in a middle portion thereof.

Another threaded bolt (not numbered) is inserted in the aperture 64 of the lever 62 of each linkage 60 and an aperture (not numbered) made in a corresponding lateral crank 85, thereby connecting the levers 62 of the linkages 60 to the crankshaft 88. Another threaded bolt (not numbered) is inserted in the slot 69 of the lever 62 and one of the apertures 61 of the lever 66, thereby connecting an end of the lever 62 to a first end of the lever 66. Another threaded bolt (not numbered) is inserted in the aperture 68 of the lever 66 of each linkage 60 and a corresponding positioning element 51, thereby pivotally connecting the lever 66 to the element 51. Now, a second end of the lever 66 is close to the upper leg-rest frame 80. A caster 65 is supported on an axle 63 connected to the second end of the lever 66 of each linkage 60.

Referring to FIGS. 2, 4 and 6, the lift unit 16 includes a power element 90, a rod 92, a headrest driver 91, a backrest lever 93 and a backrest driver 98. The power element 90 can be a pneumatic or hydraulic cylinder for extending the rod 92. The power element 90 includes an end 94 pivotally connected to a pair of holding elements 59 of the sliding frame 50. The rod 92 includes an end 96 pivotally connected to an end of the backrest driver 98. Another end of the backrest driver 98 is pivotally connected to an end of the headrest driver 91. Another end of the headrest driver 91 is pivotally connected to the headrest frame 76.

The power element 90 can be a motor equipped with a gearbox in another embodiment.

One pair of lugs 74 is pivotally connected to the backrest driver 98 via a pair of bent backrest levers 93. A roller 95 is rotationally connected to the pair of backrest levers 93. In detail, each backrest lever 93 includes a first end pivotally connected to the backrest driver 98, a second end that supports the roller 95, and a middle portion pivotally connected to a corresponding lug 74. A threaded bolt 97 is inserted in the slots 71 of the other pair of lugs 74 and apertures (not numbered) made in the backrest driver 98.

Figure 21:
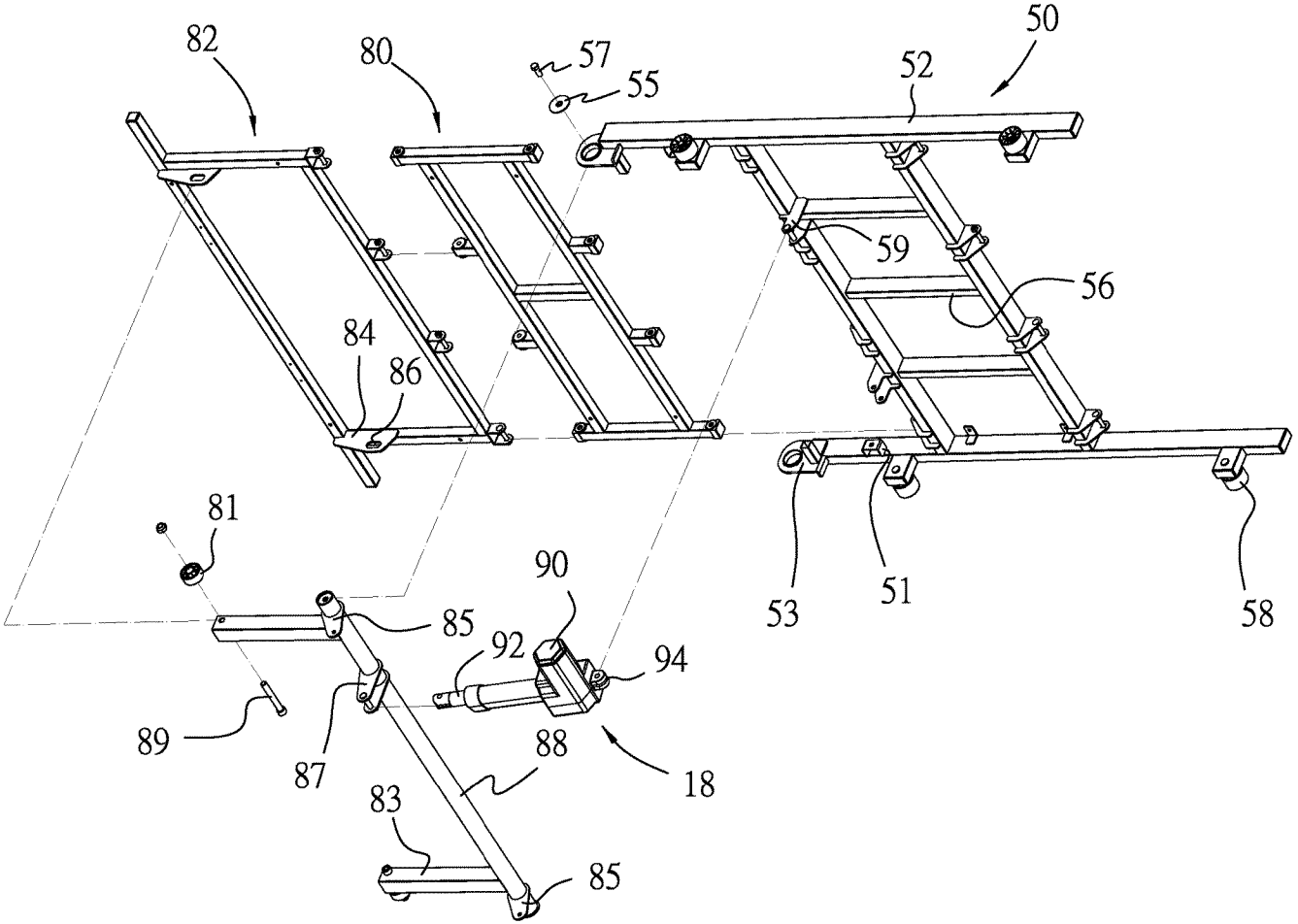
FIG. 21 is an enlarged perspective view of another lift unit of the electric bed shown in FIG. 2.

Referring to FIGS. 2, 4 and 21, the lift unit 18 includes a power element 90 and a rod 92. An end 94 of the power element 90 of the lift unit 18 is pivotally connected to the other pair of holding elements 59 of the sliding frame 50. An end 96 of the rod 92 of the lift unit 18 is pivotally connected to the cranks 87 of the crankshaft 88.

The use of the lift unit 16 to lift and lower the headrest 22 and the backrest 24 will be described.

Figure 8:
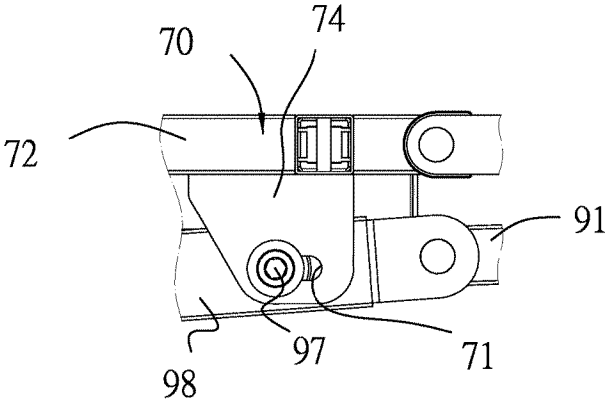
FIG. 8 is an enlarged partial view of the electric bed shown in FIG. 7.
Figure 9:
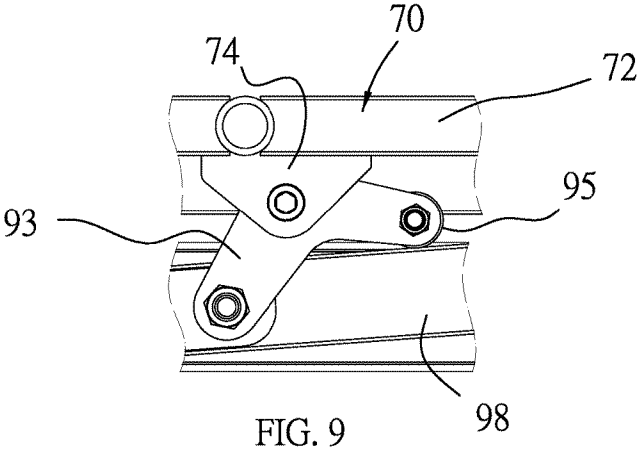
FIG. 9 is another enlarged partial view of the electric bed shown in FIG. 7.
Figure 7:
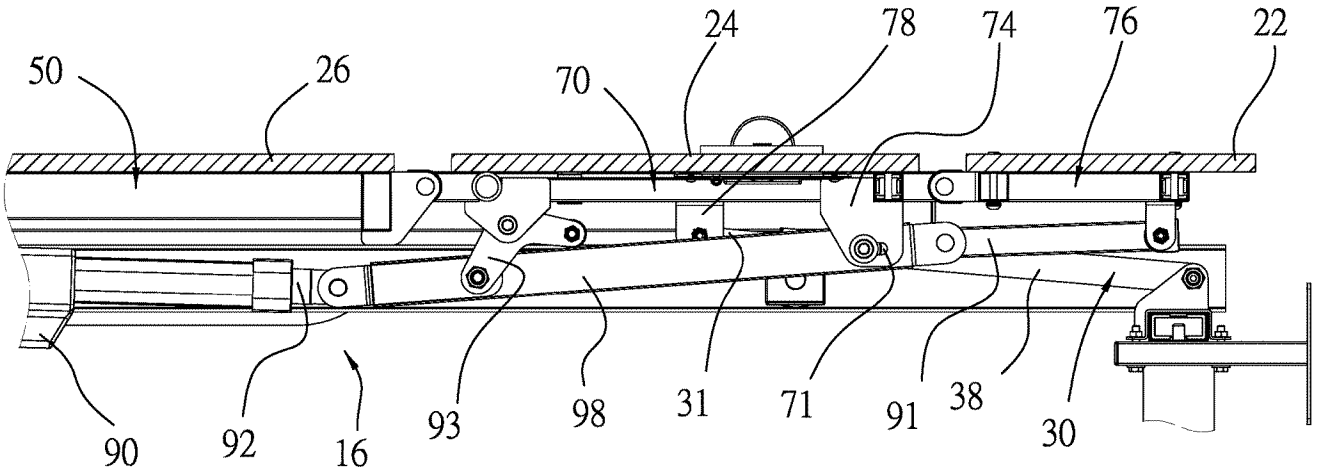
FIG. 7 is an enlarged partial cross-sectional view of the electric bed shown in FIG. 3.

Referring to FIGS. 7 to 9, the lift unit 16 is not activated. The rod 92 supports the backrest driver 98. The backrest driver 98 supports the headrest driver 91. The headrest driver 91 abuts against the headrest frame 76. The restraint 30 abuts against the backrest frame 70 via the supportive element 78. Thus, the headrest 22 is flush with the backrest 24, and both of them are laid horizontally on the sliding frame 50. The first end of each backrest lever 93 is located near the power element 90 while the roller 95 is located near the backrest driver 98. The backrest driver 98 confines the threaded bolt 97 to an end of the slot 71 of each lug 74 that is close to the power element 90.

Figure 11:
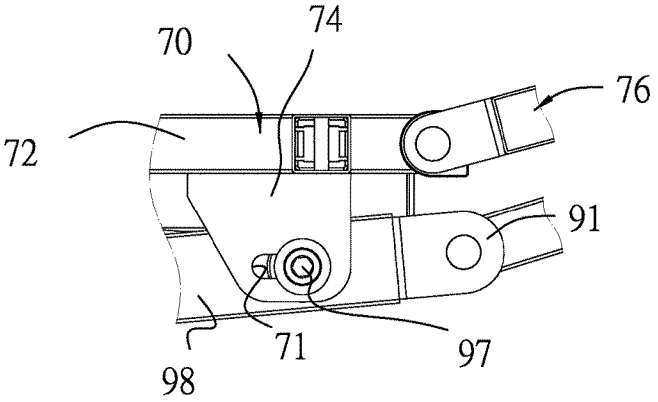
FIG. 11 is an enlarged partial view of the electric bed shown in FIG. 10.
Figure 12:
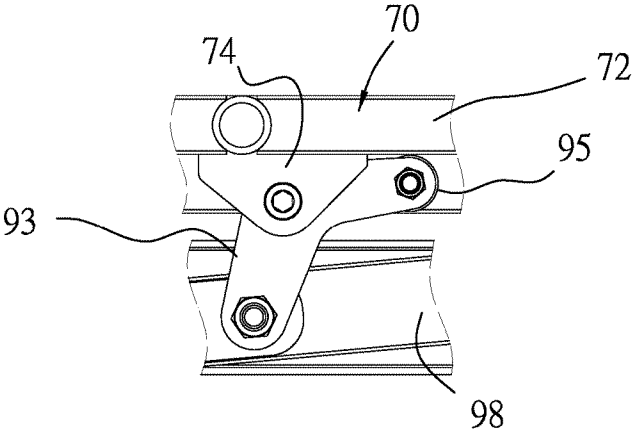
FIG. 12 is another enlarged partial view of the electric bed shown in FIG. 10.
Figure 10:
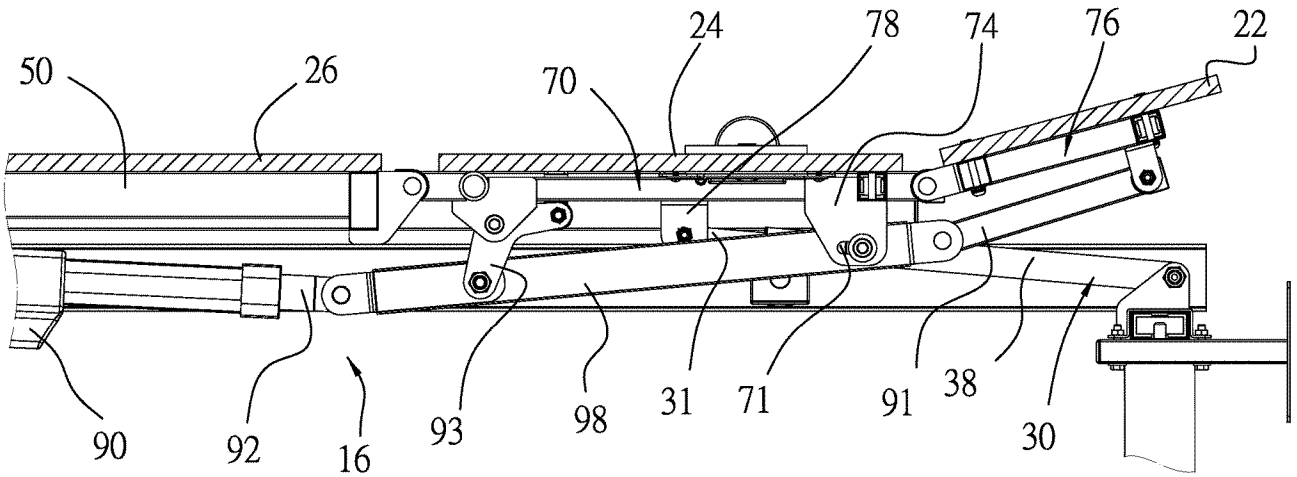
FIG. 10 is an enlarged partial cross-sectional view of the electric bed in another position than shown in FIG. 7.

Referring to FIGS. 10 through 12, the lift unit 16 is activated, i.e., the power element 90 extends the rod 92 toward the restraint 30. The rod 92 pivots counterclockwise the backrest driver 98 and the headrest driver 91. Hence, the head rest driver 91 lifts or pivots counterclockwise the headrest frame 76 relative to the backrest frame 70. However, the backrest driver 98 does not lift or pivot the headrest 22 because the threaded bolt 97 slides in the slot 71. Advantageously, the backrest 24 is not lifted until the headrest 22 is lifted for an angle of 15°±5° for example.

At the same time, the backrest driver 98 pivots the backrest lever 93 counterclockwise. Finally, the threaded bolt 97 reaches the other end of the slot 71, and the roller 95 abuts against the lateral bar 72.

Figure 13:
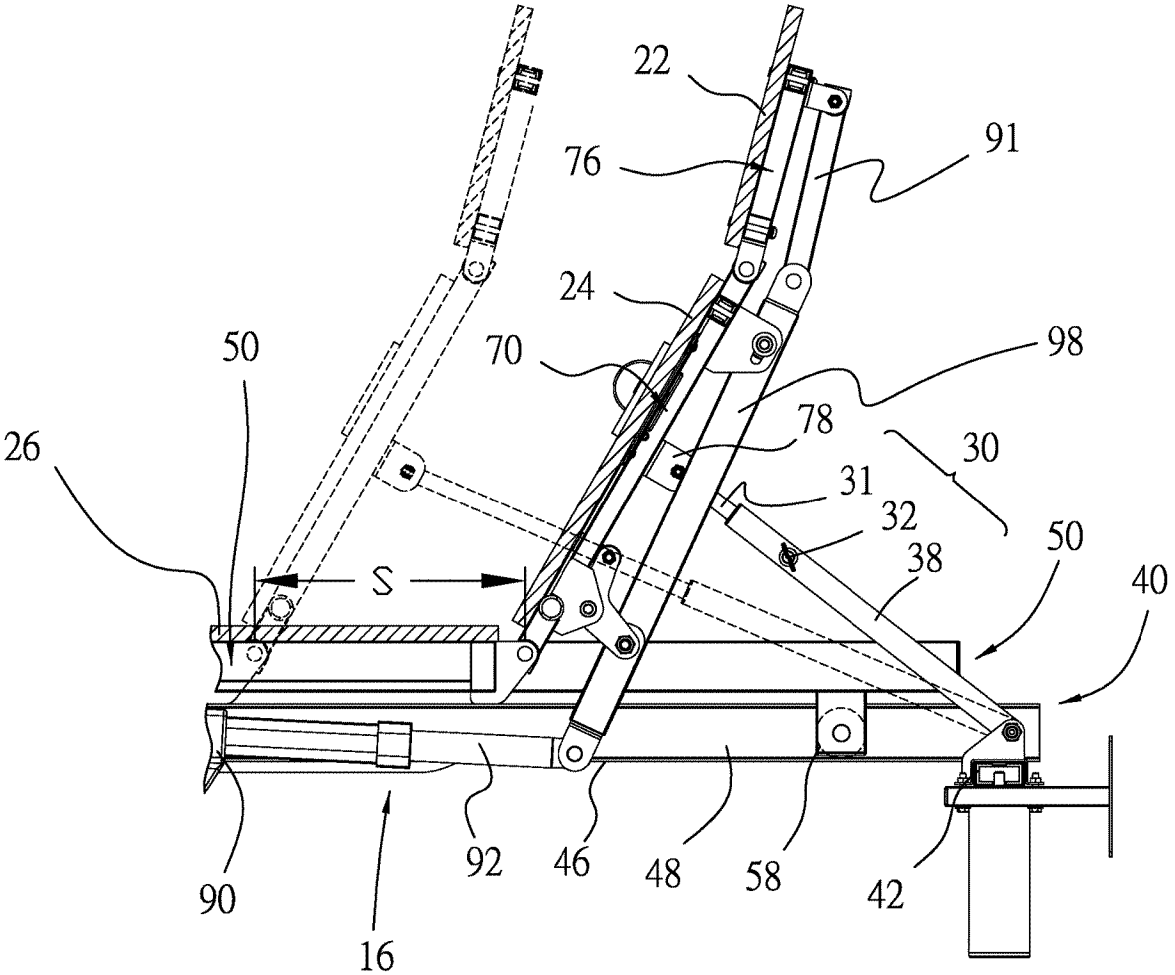
FIG. 13 is an enlarged partial cross-sectional view of the electric bed in another position than shown in FIG. 10.

Referring to FIG. 13, the power element 90 continues to extend the rod 92 toward the restraint 30, thereby continuing to pivot the backrest driver 98 and the headrest driver 91 counterclockwise. The restraint 30 remains the length and pivots with the backrest frame 70, thereby tending to move the sliding frame 50 toward the front bar 42. The casters 58 roll along the tracks 48 of the lateral bars 46 until the power element 90 stops extending the rod 92. The backrest frame 70 is pivoted on the sliding frame 50 for 60°±5°, moving the sliding frame 50, for a distance S, to a position from the original position.

The above-mentioned process can be reversed to have the lift unit 16 lower the headrest 22 and the backrest 24.

The pin 32 can be removed from the cylinder 38 to allow the rod 31 to extend from and withdraw into the cylinder 38, thereby changing the length of the restraint 30. Thus, the restraint 30 extends as the backrest frame 70 rises, without pulling the sliding frame 50. Hence, the sliding frame 50 stays where it is, and the restraint 30, the backrest frame 70 and the headrest frame 76 reach a position shown by phantom lines in FIG. 13.

The use of the lift unit 18 to lift and lower the lower leg-rest 21 and the upper leg-rest 28 will be described.

Figure 15:
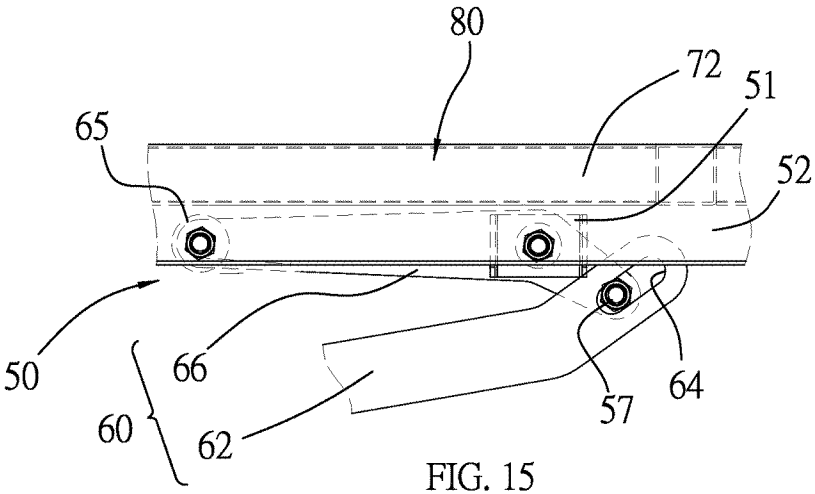
FIG. 15 is an enlarged partial view of the electric bed shown in FIG. 14.
Figure 16:
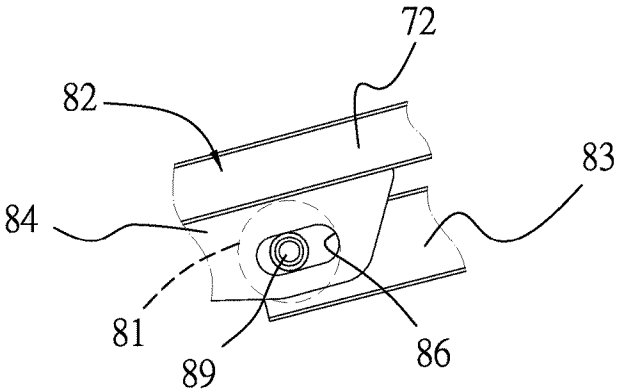
FIG. 16 is another enlarged partial view of the electric bed shown in FIG. 14.
Figure 14:
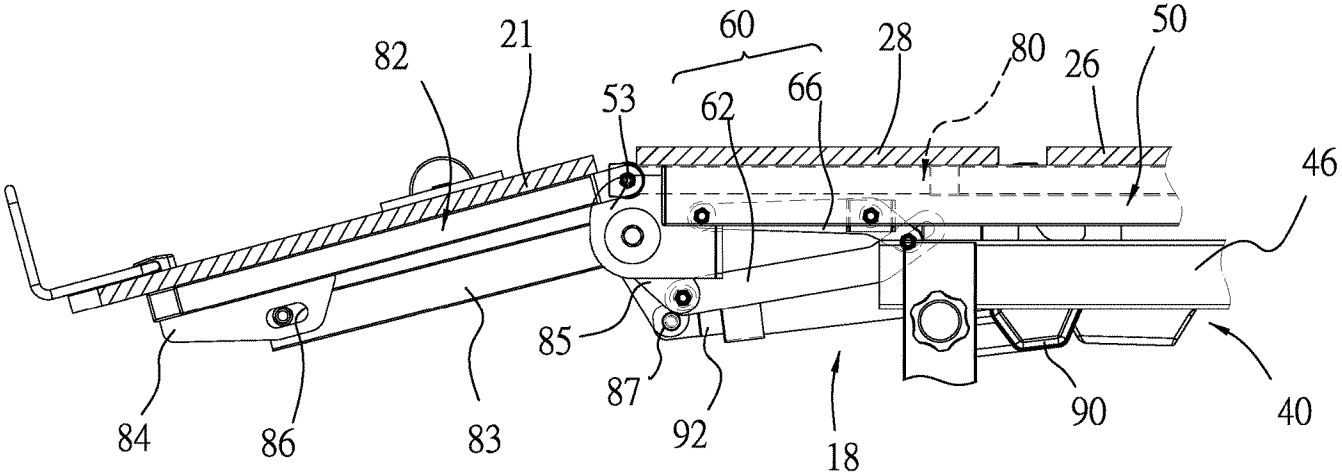
FIG. 14 is another enlarged partial cross-sectional view of the electric bed shown in FIG. 13.

Referring to FIGS. 14 to 16, the lift unit 18 is idle to allow the lower leg-rest 21 to tilt down because of gravity. Each caster 81 supports the lower leg-rest 21 and the lower leg-rest frame 82, thereby locating the axle 89 near an end of the corresponding slot 86. The caster 65 of each linkage 60 is away from the upper leg-rest frame 80, locating the threaded bolt of the lever 66 near an end of the slot 69 of the lever 62.

Figure 18:
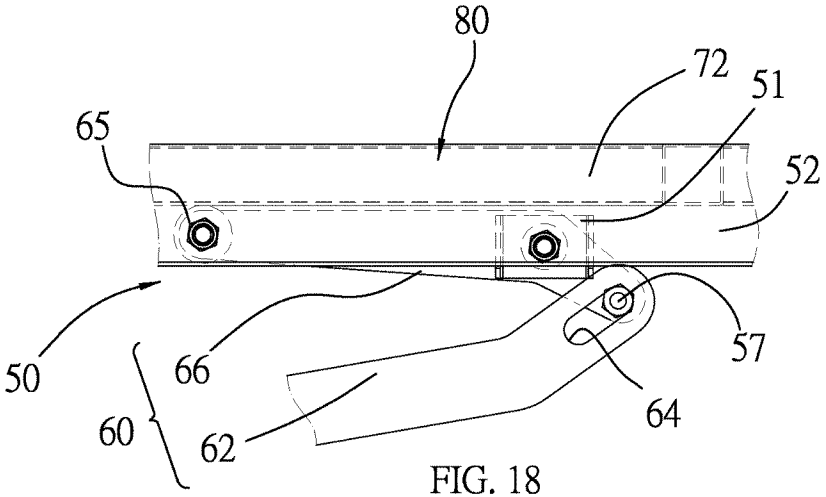
FIG. 18 is an enlarged partial view of the electric bed shown in FIG. 17.
Figure 19:
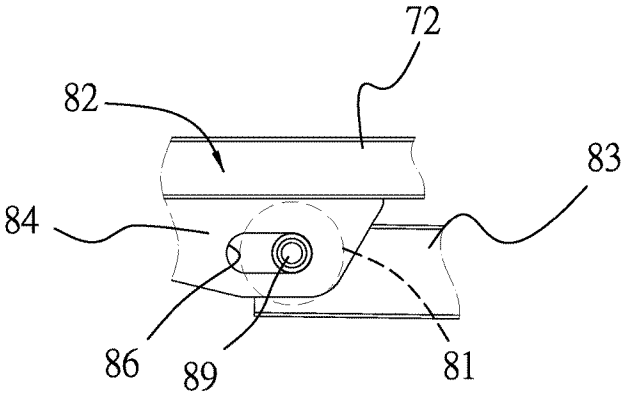
FIG. 19 is another enlarged partial view of the electric bed shown in FIG. 17.
Figure 17:
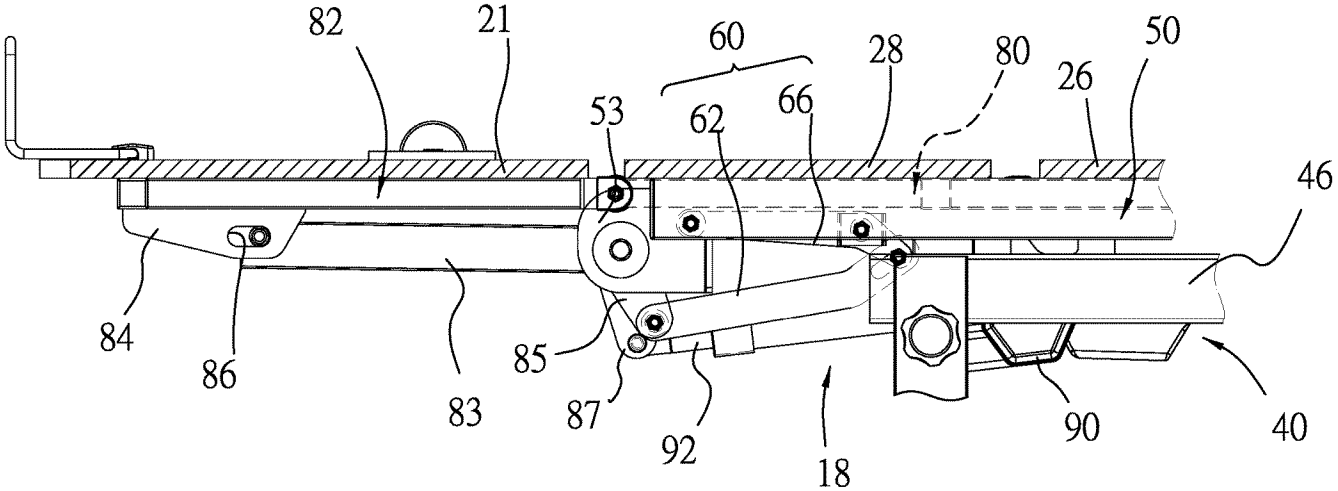
FIG. 17 is an enlarged partial cross-sectional view of the electric bed in another position than shown in FIG. 14.

Referring to FIGS. 17 through 19, the lift unit 18 is activated. The power element 90 extends the rod 92. The rod 92 pushes the pair of cranks 87 to pivot the cranks 83 and the lateral cranks 85 clockwise. The cranks 83, the lower leg-rest frame 82 and the lower leg-rest 21 are pivoted to a horizontal position, thereby confining the axle 89 to another end of the corresponding slot 86. Synchronously, each lateral crank 85 moves the corresponding lever 62, thereby confining the axle 89 of the caster 81 to another end of the slot 86 and having the caster 65 abut against a corresponding lateral bar 72 of the upper leg-rest frame 80.

Figure 20:
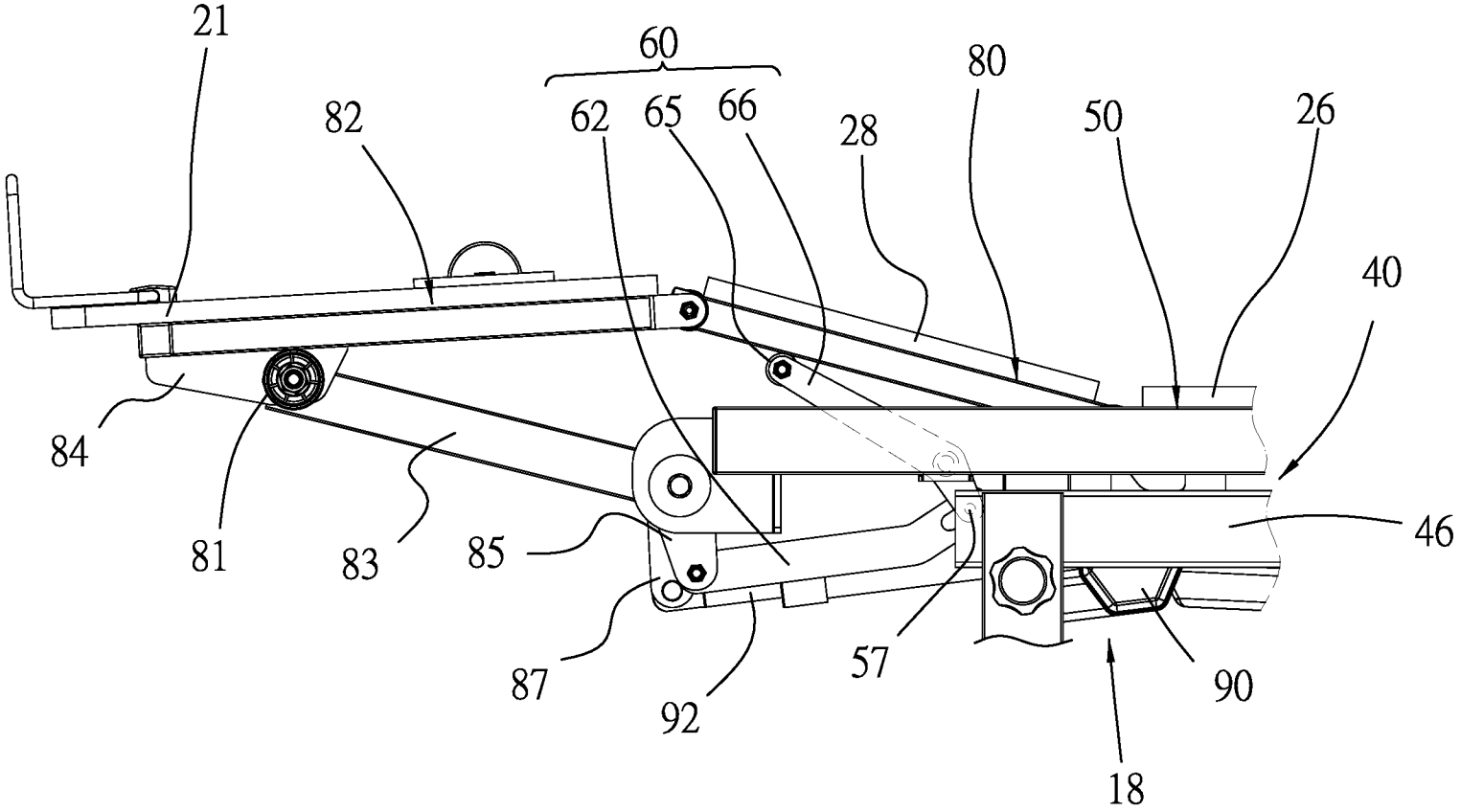
FIG. 20 is an enlarged partial view of the electric bed shown in FIG. 3.

Referring to FIG. 20, the power element 90 continues to extend the rod 92, thereby allowing the cranks 83 to continue to lift the lower leg-rest frame 82 and the lower leg-rest 21. The lever 62 pivots the lever 66 to keep the upper leg-rest frame 80 and the upper leg-rest 28 at an angle relative to the sliding frame 50 (or the middle board 26).

The cranks 83 pivot for 45°±5°. The lower leg-rest 21 pivots for 15°±5°.

The above-mentioned process can be reversed to have the lift unit 18 lower the lower leg-rest 21 and the upper leg-rest 28.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An electric bed comprising:

a basic unit comprising:

a base;

a sliding frame supported on the base;

a backrest frame pivotally connected to the sliding frame and formed with at least one lug, wherein the lug is made with a slot that comprises a closed end;

a headrest frame pivotally connected to the backrest frame; and at least one restraint comprising an end pivotally connected to the base and another end pivotally connected to the backrest frame; and a lift unit comprising:

a power element connected to the sliding frame;

a rod operatively connected to the power element;

a backrest driver pivotally connected to the rod;

a headrest driver pivotally connected to the backrest driver;

a backrest lever for pivotally connecting the backrest driver to the backrest frame;

a roller supported on the backrest lever; and a threaded bolt inserted in the backrest driver and the slot of the lug of the backrest frame;

wherein the lift unit is operable to cause the backrest driver to move the threaded bolt in the slot and cause the headrest driver to lift the headrest frame, wherein the roller is away from the backrest frame before the threaded bolt reaches the closed end of the slot, and the roller is in contact with the backrest frame when the threaded bolt reaches the closed end of the slot.

2. The electric bed according to claim 1, wherein the power element is a pneumatic cylinder.

3. The electric bed according to claim 1, wherein the power element is a hydraulic cylinder.

4. The electric bed according to claim 1, wherein the power element comprises a motor.

5. The electric bed according to claim 1, wherein the headrest frame can be lifted for 15°±5°.

6. The electric bed according to claim 1, wherein the backrest frame can be lifted for 60°±5°.

7. The bed according to claim 1, wherein the base comprises two tracks, the sliding frame comprises two pairs of casters movable along the tracks.

8. The bed according to claim 1, wherein the restraint is a cylinder device.

9. The bed according to claim 8, wherein the restraint comprises a cylinder, a rod partially inserted in and operatively connected to the cylinder, and a pin adapted for insertion in the cylinder to keep the rod in position relative to the cylinder.

* * * * *